US007625326B2

(12) United States Patent
Teeter et al.

(10) Patent No.: US 7,625,326 B2
(45) Date of Patent: Dec. 1, 2009

(54) TABLE FOR TILTING INVERSION EXERCISER

(76) Inventors: Roger C. Teeter, 20720 Snag Island Dr., Sumner, WA (US) 98390; Lopin Wang, 16F-2, No. 62, Sec. 2, Chonder 2nd Road, Beitun Chu, Taichung (TW) 40652

( * ) Notice: Subject to any disclaimer, the term of this patent is extended or adjusted under 35 U.S.C. 154(b) by 91 days.

(21) Appl. No.: 11/983,338

(22) Filed: Nov. 8, 2007

(65) Prior Publication Data

US 2009/0124473 A1 May 14, 2009

(51) Int. Cl.
*A63B 26/00* (2006.01)

(52) U.S. Cl. ..... 482/144; 482/145

(58) Field of Classification Search ..... 482/144–145, 482/23

See application file for complete search history.

(56) References Cited

U.S. PATENT DOCUMENTS 7,052,448 B2 * 5/2006 Teeter ..... 482/144
7,063,652 B1 6/2006 Teeter et al. ..... 482/145
7,118,518 B1 * 10/2006 Teeter ..... 482/144
2004/0226099 A1 * 11/2004 Pearce ..... 5/655.5
2006/0103222 A1 * 5/2006 Caruso et al. ..... 297/452.15
2006/0128539 A1 * 6/2006 Marquez ..... 482/123

* cited by examiner

*Primary Examiner*—Lori Amerson

(57) ABSTRACT

A tilting inversion exerciser includes a lower supporting stand having an axle, and a table rotatably supported on the stand with the axle, the table is made of plastic material and having a resilient one-integral-piece structure for smoothly engaging with the back portion of the user and for comfortably supporting the user, and for easily sterilizing purposes particularly following use by someone just finishing a workout and very sweaty. The table is pivotally supported on a base with a frame and one or more arms in which the arms are pivotally supported on the base and limited to pivot or to rotate relative to the base.

9 Claims, 9 Drawing Sheets

TABLE FOR TILTING INVERSION EXERCISER

BACKGROUND OF THE INVENTION

1. Field of the Invention

The present invention relates to a tiltable or a tilting inversion exerciser, and more particularly to a tilting inversion exerciser having a comfortable resilient or flexible supporting table for comfortably supporting the user and for stably supporting the user on the supporting table.

2. Description of the Prior Art

Various kinds of typical inversion suspension exercisers, rotational exercisers, tilting inversion exercisers etc. have been developed and comprise a user supporting table rotatably or pivotally attached to a base support, and rotatable relative to the base support for conducting various inversion or suspension exercises.

For example, U.S. Pat. No. 7,052,448 to Teeter discloses one of the typical inversion suspension exercisers and comprises a user supporting table pivotally or rotatably attached to a base support with one or more pivots for allowing the users and the user supporting table to be rotated relative to the base support, and a massage device disposed in the user supporting table for massaging the users.

However, the massage device should be engaged within a soft cushion for engaging with the back portions of the users and for massaging the back portions of the users, and the back portions of the users will be and should be engaged with the massage device such that the users may not be comfortably or relaxedly supported on the supporting table.

U.S. Pat. No. 7,063,652 to Teeter discloses another typical inversion suspension exerciser comprising a user supporting table pivotally or rotatably attached to a base support with an axle, and a driving device attached to the user supporting table and having a reduction gearing coupled to the axle to drive and to rotate the user supporting table relative to the base support.

However, the supporting table includes a planar structure which may not comfortably or relaxedly support the back portions of the users.

U.S. Pat. No. 7,118,518 to Teeter discloses a further typical inversion suspension exerciser also comprising a user supporting table pivotally or rotatably attached to a base support with an axle, and the user supporting table is made of an outer peripheral frame, and a canvas engaged onto the outer peripheral frame for supporting the user.

However, the canvas is too soft and may not suitably support the user such that the outer portions or the side portions of the users will be curved or forced upwardly and inwardly and such that the user also may not feel comfortable when supported on the user supporting tables. In addition, the canvas is not good for sterilizing purposes particularly following use by someone just finishing a workout and very sweaty, and the outer peripheral frame may limit the stretching of the users.

The present invention has arisen to mitigate and/or obviate the afore-described disadvantages of the conventional user supporting tables for the tilting inversion exercisers.

SUMMARY OF THE INVENTION

The primary objective of the present invention is to provide a tilting inversion exerciser including a comfortable resilient or flexible supporting table for comfortably supporting the user.

The other objective of the present invention is to provide a tilting inversion exerciser including a comfortable resilient or flexible supporting table having a resilient and one-integral-piece structure for smoothly engaging with the back portion of the user and for easily sterilizing purposes particularly following use by someone just finishing a workout and very sweaty.

The further objective of the present invention is to provide a tilting inversion exerciser including a resilient or flexible supporting table having no peripheral frames provided thereon for allowing the user to free to rotate to one side or the other by 15 to 20 degrees, and thus for suitably improving the stretching of the user.

In accordance with one aspect of the invention, there is provided a tilting inversion exerciser comprising a lower supporting stand, and a table rotatably supported on the stand, the table being made of plastic material and having a resilient one-integral-piece structure for smoothly engaging with the back portion of the user and for easily sterilizing purposes particularly following use by someone just finishing a workout and very sweaty, and the table has no peripheral frames provided thereon for allowing the user to free to rotate to one side or the other by 15 to 20 degrees, and thus for suitably improving the stretching of the user.

The table includes a number of orifices formed therein for air circulation purposes. The stand includes an axle disposed thereon, and a base rotatably attached to the stand with the axle for supporting the table.

The table includes at least one hub extended downwardly therefrom, the base includes a frame disposed thereon, and the frame includes at least one barrel having an upper curved depression formed therein for pivotally or rotatably engaging with the hub of the table.

The frame includes a curved gasket engaged in the curved depression of the barrel for engaging with the hub of the table. The base includes a bracket provided thereon and secured to the frame with at least one fastening member.

The barrel includes a bore formed therein and communicating with the curved depression thereof for engaging with a fastener therein. The table includes a curved cavity formed in the hub, and the fastener includes a curved head rotatably engaged in the curved cavity of the hub.

The barrel includes a lower curved recess formed therein and communicating with the bore thereof for engaging with a curved lock nut which is threaded to the fastener.

The table includes at least one hub extended downwardly therefrom, the base includes at least one arm disposed thereon, and the arm includes at least one barrel having an upper curved depression formed therein for rotatably engaging with the hub of the table.

The arm includes a curved gasket engaged in the curved depression of the barrel for engaging with the hub of the table. The barrel of the arm includes a bore formed therein and communicating with the curved depression thereof for engaging with a fastener therein.

The table includes a curved cavity formed in the hub, and the fastener includes a curved head rotatably engaged in the curved cavity of the hub. The includes a lower curved recess formed therein and communicating with the bore thereof for engaging with a curved lock nut which is threaded to the fastener.

The base includes a bar, and the arm includes a notch formed therein for engaging with the bar and pivotally securing to the bar with a pivot pin. The arm includes two inclined surfaces formed therein for selectively engaging with the bar and for limiting the arm to pivot relative to the bar and thus for pivotally or resiliently supporting the table.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
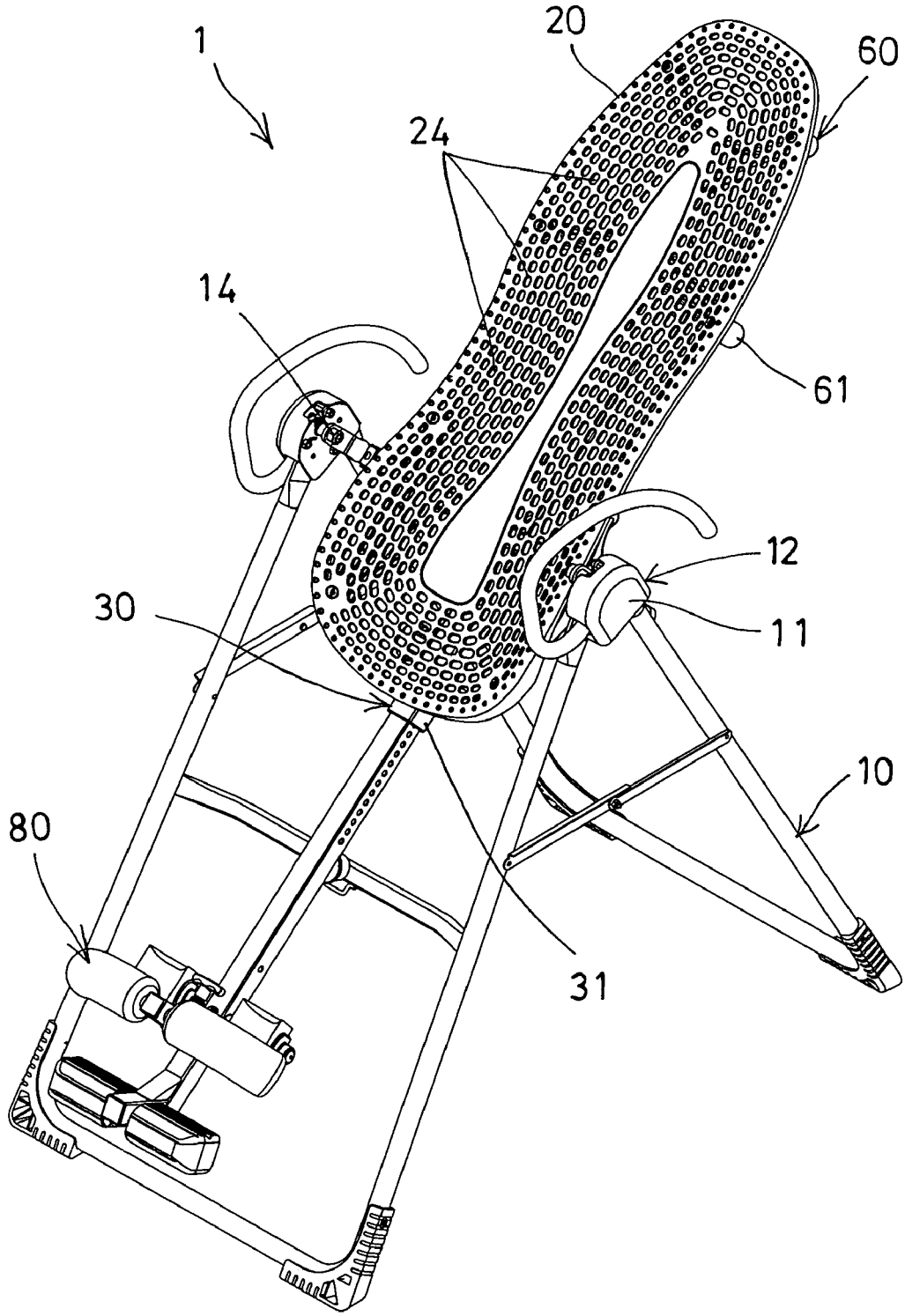
FIG. 1 is a front perspective view of a tilting inversion exerciser in accordance with the present invention.
Figure 2:
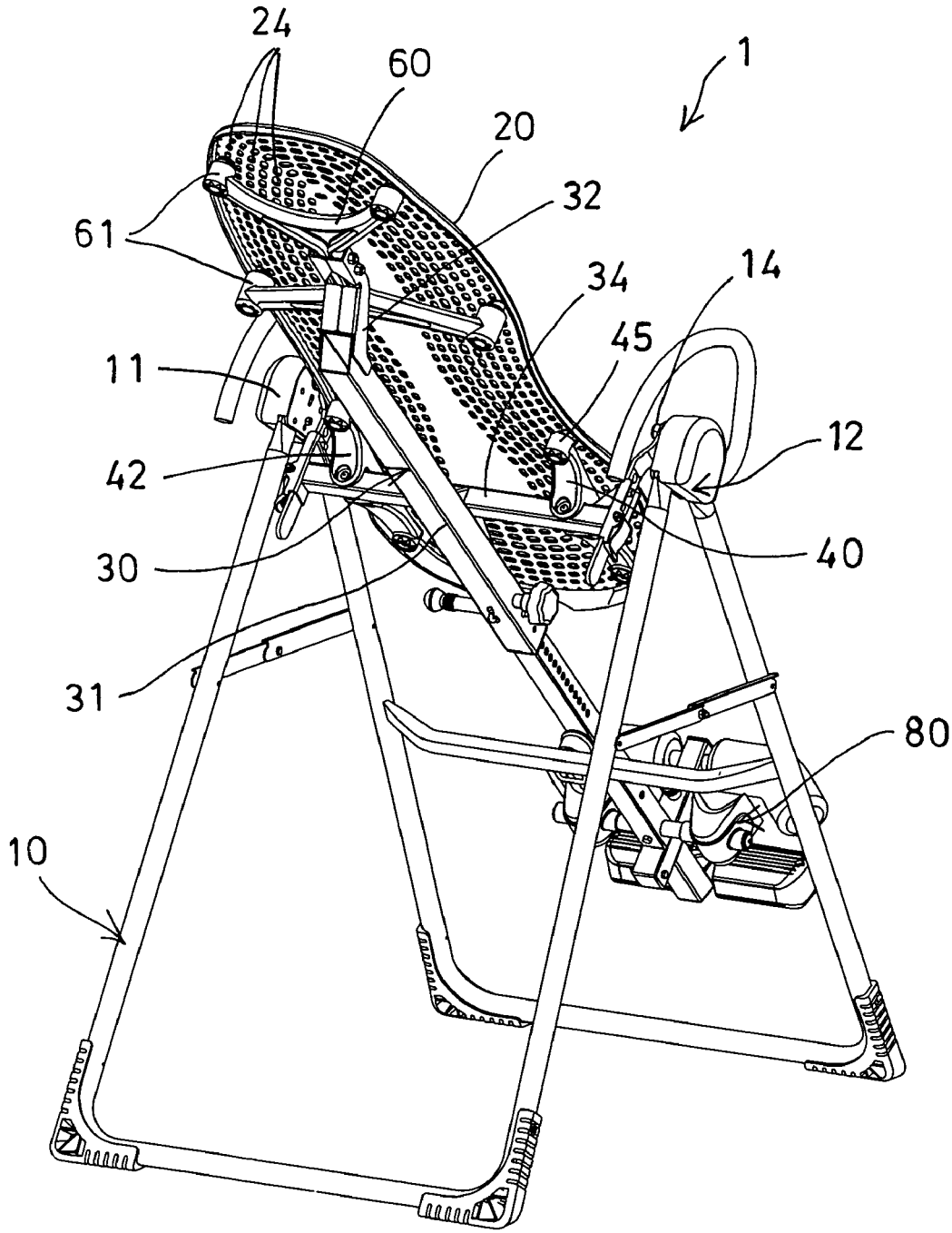
FIG. 2 is a rear perspective view of the tilting inversion exerciser.
Figure 3:
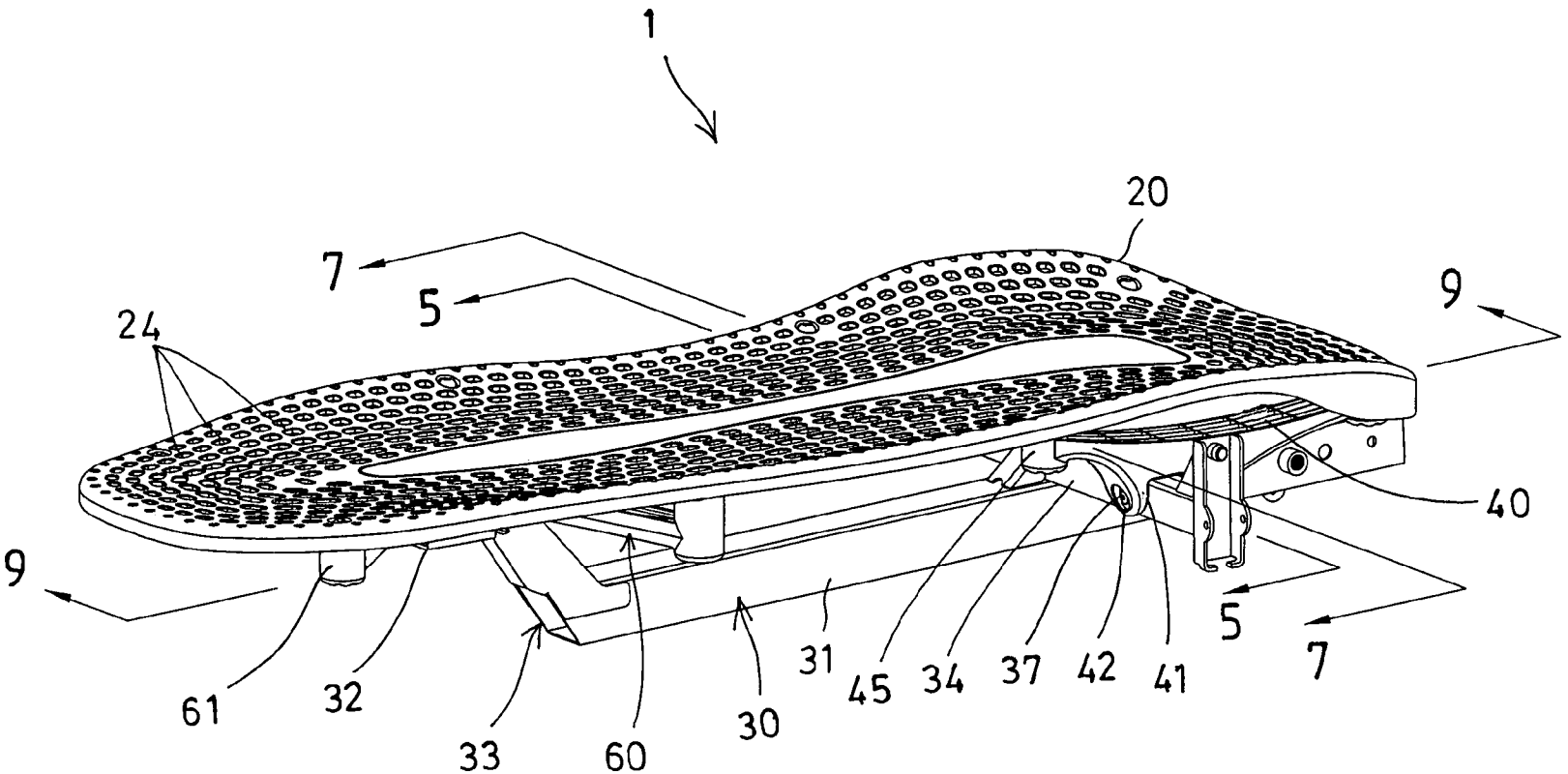
FIG. 3 is an upper perspective view illustrating a user supporting table of the tilting inversion exerciser.

Referring to the drawings, and initially to FIGS. 1-2, a tilting inversion exerciser 1 in accordance with the present invention comprises a lower supporting stand 10 including two apex-connecting hubs or members 11 provided on the upper portion 12 of the lower supporting stand 10 each for rotatably receiving a pivot axle 14 therein with one or more bearings (not shown) for pivotally or rotatably supporting a resilient or flexible user supporting table 20 which is provided for comfortably supporting the user (not shown) or for stably supporting the user on the user supporting table 20.

A base 30 includes a longitudinal beam 31, a bracket 32 formed or provided on the front portion 33 of the beam 31, a bar 34 laterally disposed or attached to the middle portion 35 of the beam 31 and having two side portions 36 pivotally or rotatably attached to the lower supporting stand 10 with the pivot axles 14 for allowing the base 30 and the user supporting table 20 to be pivoted or rotated relative to the lower supporting stand 10 with or about the pivot axles 14. It is preferable that the base 30 and the user supporting table 20 are rotatable relative to the lower supporting stand 10 for 360 degrees. A foot retaining device 80 may be adjustably attached or secured to the beam 31 (FIGS. 1, 2) for suitably engaging with the feet of the users.

Figure 5:
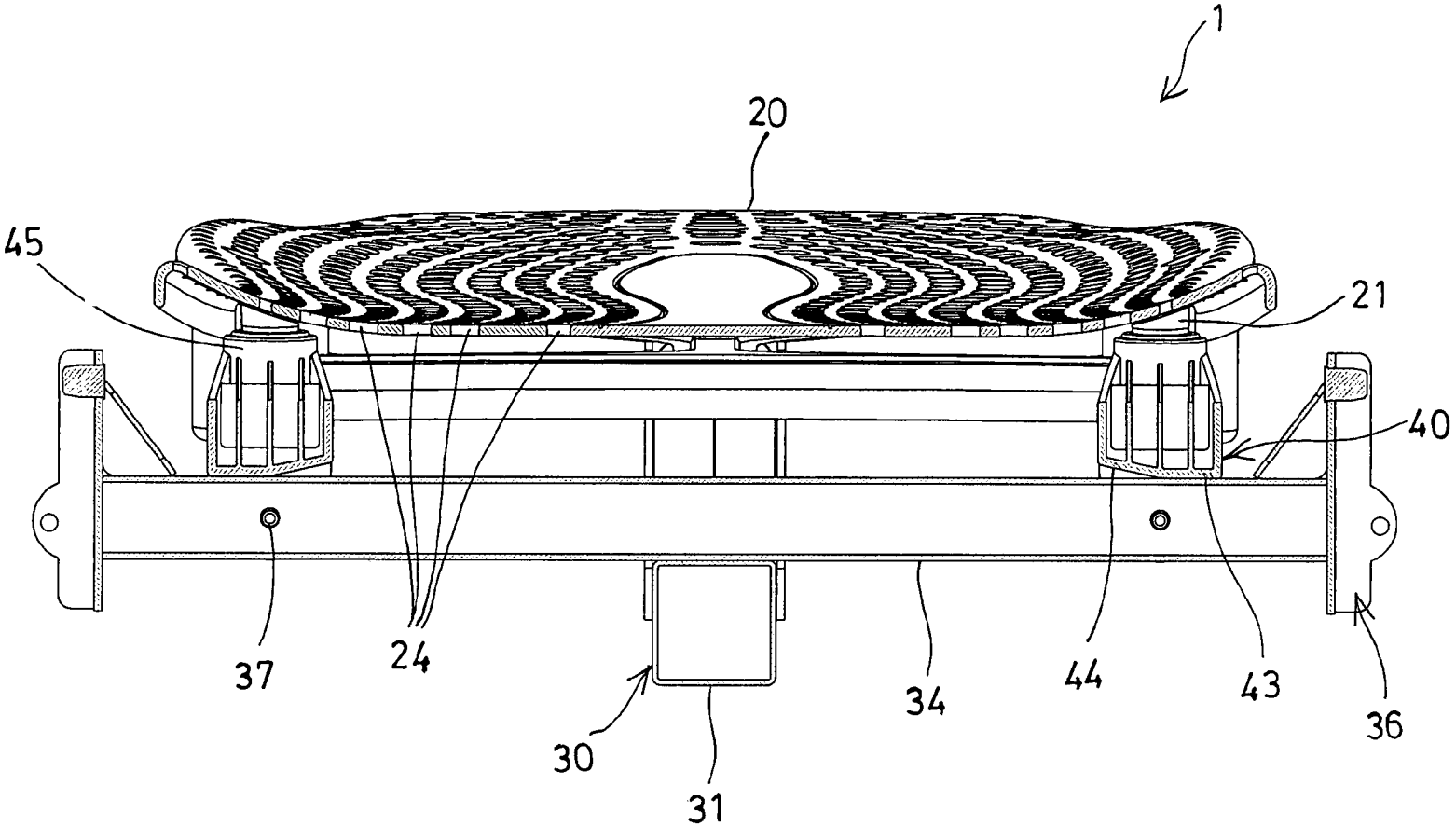
FIG. 5 is a cross sectional view of the tilting inversion exerciser taken along lines 5-5 of FIG. 3.
Figure 6:
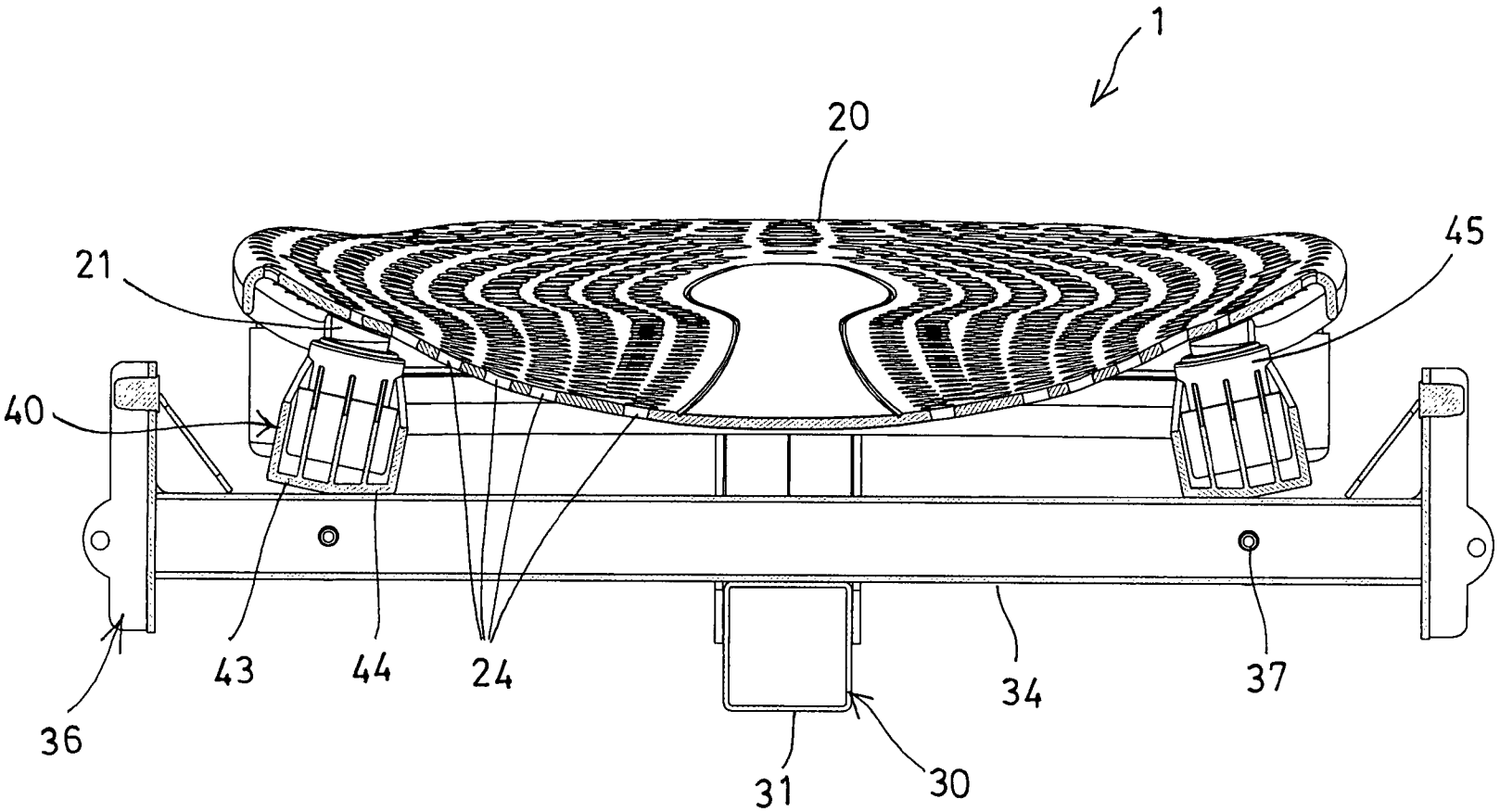
FIG. 6 is a cross sectional view similar to FIG. 5, illustrating the operation of the tilting inversion exerciser.

One or more (such as two) arms 40 each include a notch 41 formed therein, such as formed in the bottom portion thereof and formed or defined between two protrusions 42 for receiving or for engaging with the bar 34 and for pivotally attached or secured to the bar 34 with such as pivot pins 37 and thus for allowing the arms 40 to be pivoted or rotated relative to the bar 34 with or about the pivot pins 37 respectively (FIGS. 5, 6). It is preferable that the arms 40 each include two inclined surfaces 43, 44 formed therein, such as formed between the protrusions 42 and formed in the base or inner portion of the notch 41 thereof and formed or located on the opposite sides of the pivot pins 37 for selectively engaging with the bar 34 and for limiting the arms 40 to pivot or to rotate relative to the bar 34.

Figure 4:
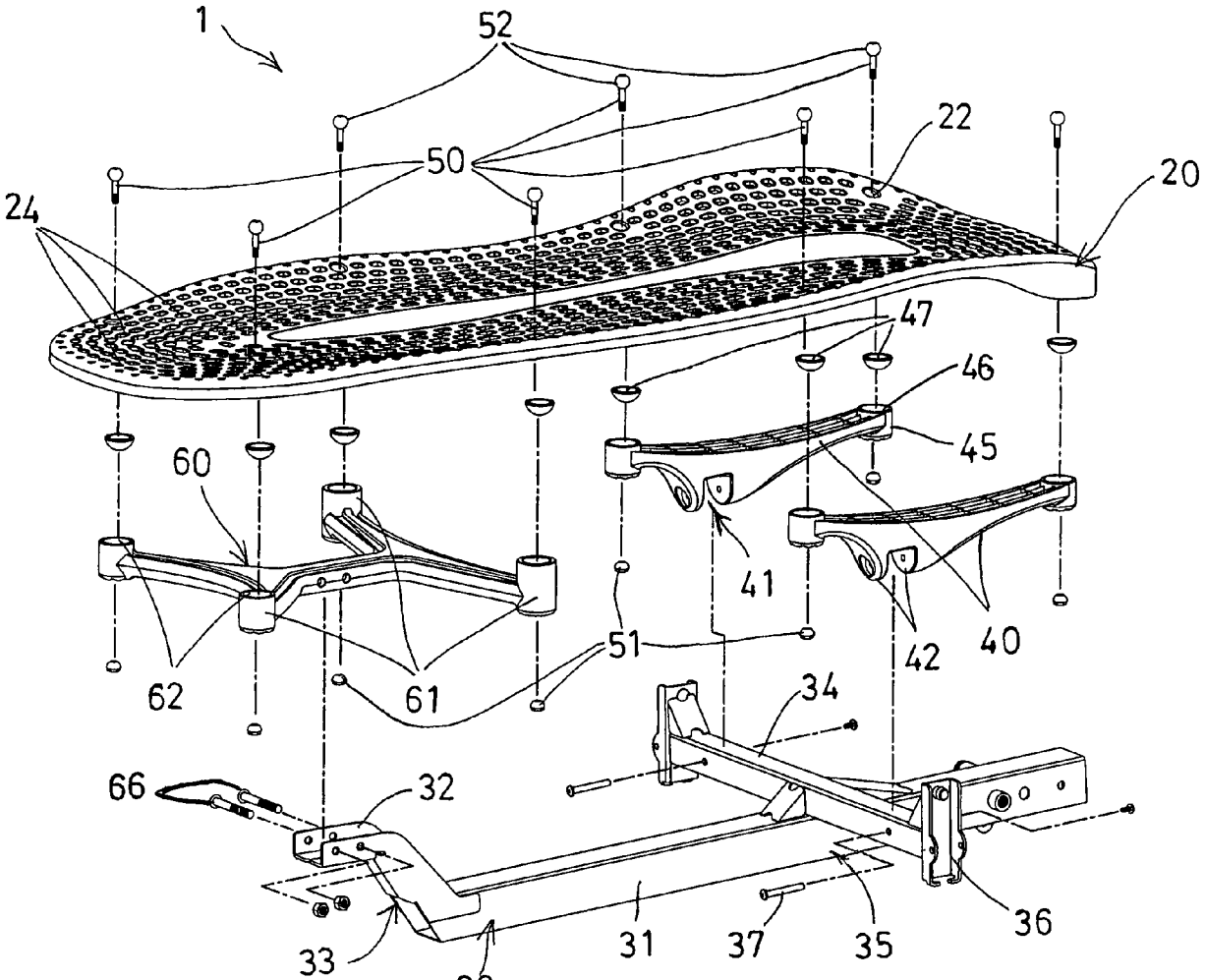
FIG. 4 is a partial exploded view of the user supporting table of the tilting inversion exerciser.
Figure 7:
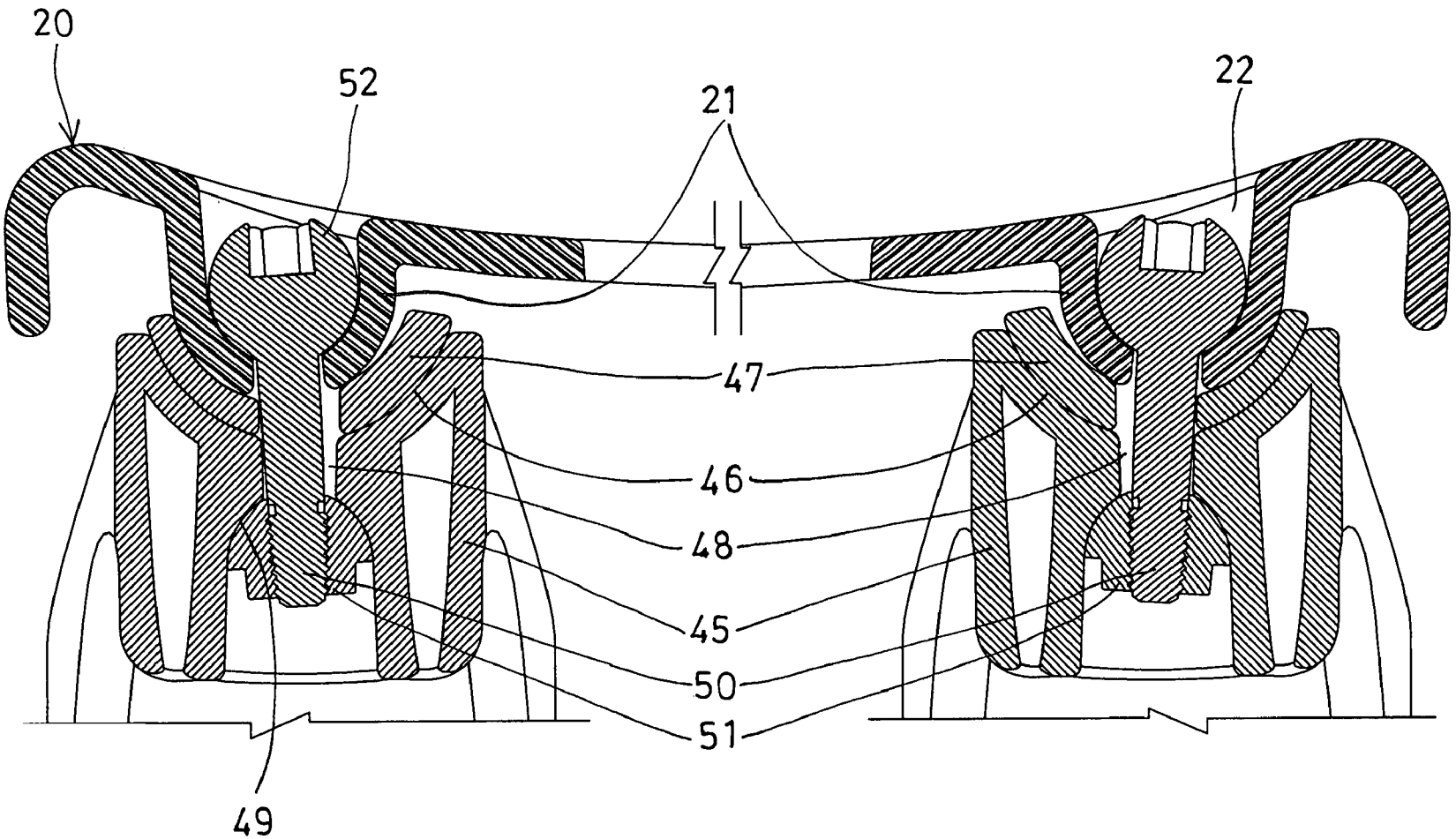
FIG. 7 is a cross sectional view of the tilting inversion exerciser taken along lines 7-7 of FIG. 3.
Figure 8:
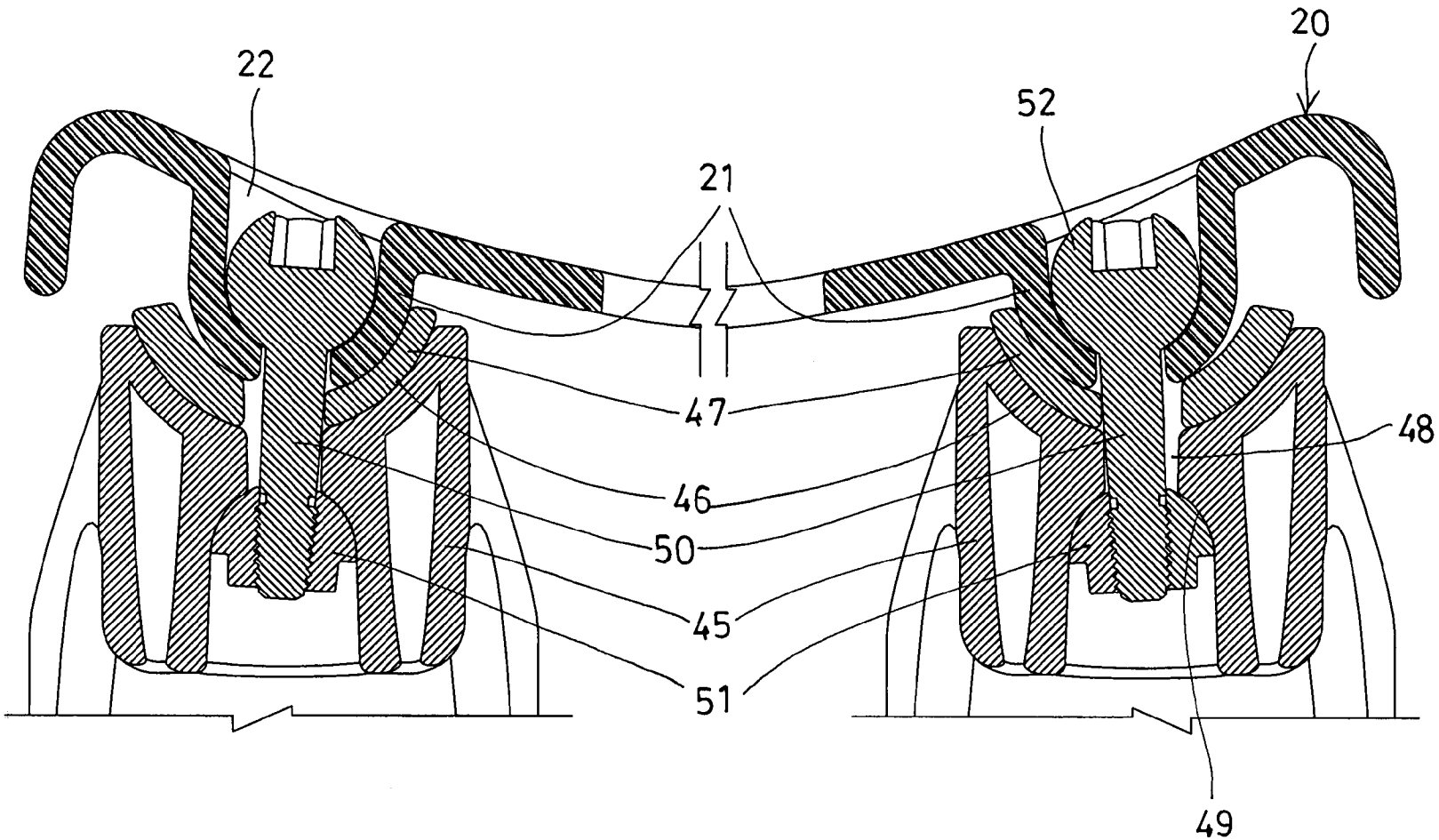
FIG. 8 is a cross sectional view similar to FIG. 7, illustrating the operation of the tilting inversion exerciser.

The arms 40 each include one or more (such as two) hubs or barrels 45 formed or provided on the two end portions thereof, and the barrels 45 each include a curved depression 46 formed in the upper portion thereof for receiving or engaging with a curved gasket 47 (FIGS. 4, 7, 8), and each include a bore 48 formed therein and communicating with the curved depression 46 thereof for receiving or engaging with a fastener 50 therein, and each include a curved recess 49 formed therein, such as formed in the lower or bottom portion thereof and communicating with the bore 48 thereof for receiving or engaging with a curved lock nut 51 which is threaded to the fastener 50 and for allowing the fasteners 50 to be slightly pivoted or rotated relative to the barrels 45, in which the fasteners 50 each include a curved or spherical head 52 formed or provided on top thereof.

Figure 9:
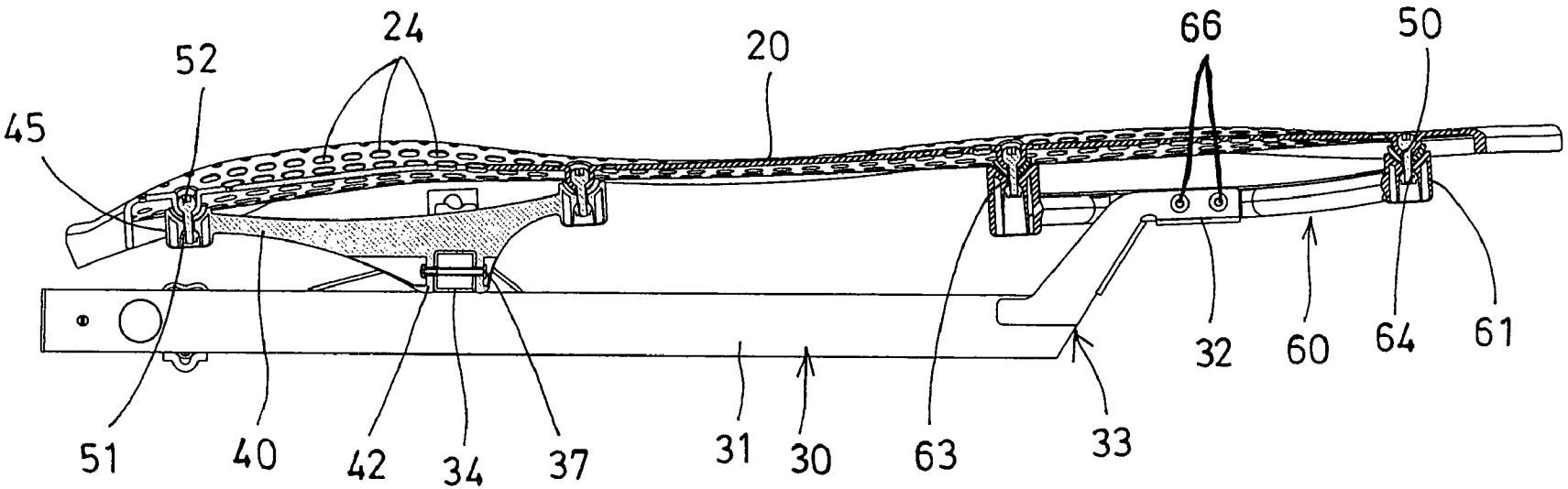
FIG. 9 is a cross sectional view of the tilting inversion exerciser taken along lines 9-9 of FIG. 3.

A frame 60 is secured to the bracket 32 of the base 30 with one or more fastening members 66, and includes a substantially I-shape having one or more (such as four) hubs or barrels 61 formed or provided on the end portions thereof, and the barrels 61 each also include a curved depression 62 formed in the upper portion thereof for receiving or engaging with a curved gasket 47, and each include a bore 63 formed therein (FIG. 9) and communicating with the curved depression 62 thereof for receiving or engaging with a fastener 50 therein, and each include a curved recess 64 formed therein, such as formed in the bottom portion thereof and communicating with the bore 63 thereof for receiving or engaging with a curved lock nut 51 and for allowing the fasteners 50 and the curved lock nuts 51 to be slightly pivoted or rotated relative to the barrels 45.

The user supporting table 20 includes a number of curved protrusion or hub 21 extended downwardly therefrom and pivotally or rotatably engaging with the curved gaskets 47 or directly engaging with the barrels 45, 61 of the arms 40 and the frame 60 respectively, and includes a curved cavity 22 formed in each of the hubs 21 for pivotally or rotatably engaging with the curved or spherical head 52 of the fastener 50, and includes a number of orifices 24 formed therein for such as air circulation purposes. The engagements of the hubs 21 with the curved gaskets 47 and/or of the hubs 21 with the curved depressions 46, 62 of the barrels 45, 61 of the arms 40 and the frame 60 respectively, and/or of the curved lock nuts 51 with the curved recesses 49, 64 of the barrels 45, 61 permit the user supporting table 20 to be slightly bent or curved or pivoted or rotated relative to the arms 40 and the frame 60.

The user supporting table 20 is made of soft or resilient plastic, rubber or synthetic materials and includes a suitable or predetermined resilience for allowing the table 20 suitably bent or curved or deformed according to the back portion of the user and for smoothly engaging with the back portion of the user and thus for comfortably supporting the user, and for easily sterilizing purposed particularly following use by someone just finishing a workout and very sweaty. The orifices 24 of the supporting table 20 allow the air to circulate through the supporting table 20 and allow the user to feel comfortable.

It is to be noted the tilting inversion exerciser in accordance with the present invention includes a comfortable resilient or soft or flexible supporting table 20 made of soft or resilient plastic, rubber or synthetic materials and may be easily and quickly formed by such as molding or mold injection processes and having a one-integral-piece structure and having a suitable or predetermined resilience for being suitably bent or curved or deformed according to the back portion of the user and for stably or snugly fitting or engaging with the back portion of the user and thus for comfortably supporting the user, and the table 20 may smoothly support the user for easily sterilizing purposes particularly following use by someone just finishing a workout and very sweaty.

It is further to be noted the tilting inversion exerciser in accordance with the present invention includes a one-integral and planar and flexible supporting table 20 which has no peripheral frames provided thereon for allowing the user to free to rotate to one side or the other by 15 to 20 degrees that may suitably improve the stretching of the user. In addition, the planar and smooth supporting table 20 offers less friction than that of the typical inversion suspension exercisers for allowing the inverted user to relax his body and to have an increased or lengthened body of about 1 to 4 cm.

Accordingly, the tilting inversion exerciser in accordance with the present invention includes a comfortable resilient or flexible supporting table having a resilient and one-integral-piece structure for smoothly engaging with the back portion of the user and for easily sterilizing purposes particularly following use by someone just finishing a workout and very sweaty, and having no peripheral frames provided thereon for allowing the user to free to rotate to one side or the other by 15 to 20 degrees, and thus for suitably improving the stretching of the user.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

We claim:

1. A tilting inversion exerciser comprising: a lower supporting stand including an axle disposed thereon, a base rotatably attached to said stand with said axle, a frame disposed on said base, at least one arm disposed on said base, and a flexible, table attached to said frame and said at least one arm for being rotatably supported on said stand with said base and said frame and said at least one arm, said table being made of plastic material and having a resilient one-integral-piece structure, said table including at least one hub extended downwardly therefrom and said frame including at least one barrel having an upper curved depression formed therein for rotatably engaging with said at least one hub of said table, wherein said frame includes a curved gasket engaged in said curved depression of said at least one barrel for engaging with said at least one hub of said table and said at least one barrel includes a bore formed therein and communicating with said curved depression thereof for engaging with a fastener, further said at least one barrel includes a lower curved recess formed therein and communicating with said bore thereof for engaging with a curved lock nut which is threaded to said fastener.

2. The tilting inversion exerciser as claimed in claim 1, wherein said table includes a plurality of orifices formed therein for air circulation purposes.

3. The tilting inversion exerciser as claimed in claim 1, wherein said base includes a bracket provided thereon and secured to said frame with at least one fastening member.

4. The tilting inversion exerciser as claimed in claim 1, wherein said table includes a curved cavity formed in said at least one hub, and said fastener includes a curved head rotatably engaged in said curved cavity of said at least one hub.

5. A tilting inversion exerciser comprising: a lower supporting stand including an axle disposed thereon, a base rotatably attached to said stand with said axle, a frame disposed on said base, at least one arm disposed on said base and having a gasket, and a flexible table attached to said frame and said at least one arm for being rotatably supported on said stand with said base and said frame and said at least one arm, said table being made of plastic material and having a resilient one-integral-piece structure, said table including at least one hub extended downwardly therefrom, and said at least one arm including at least one barrel having an upper curved depression formed therein for rotatably engaging with said at least one hub of said table, wherein said table includes a curved cavity formed in said at least one hub, and said fastener includes a curved head rotatable engaged in said curved cavity of said at least one hub, and wherein said at least one arm includes two inclined surfaces formed therein for selectively engaging with said bar and for limiting said at least one arm to pivot relative to said bar.

6. The tilting inversion exerciser as claimed in claim 5, wherein said at least one arm includes a curved gasket engaged in said curved depression of said at least one barrel for engaging with said at least one hub of said table.

7. The tilting inversion exerciser as claimed in claim 5, wherein said at least one barrel of said at least one arm includes a bore formed therein and communicating with said curved depression thereof for engaging with a fastener therein.

8. The tilting inversion exerciser as claimed in claim 7, wherein said at least one barrel includes a lower curved recess formed therein and communicating with said bore thereof for engaging with a curved lock nut which is threaded to said fastener.

9. The tilting inversion exerciser as claimed in claim 5, wherein said base includes a bar, and said at least one arm includes a notch formed therein for engaging with said bar and pivotally securing to said bar with a pivot pin.

* * * * *